US006422566B1

(12) United States Patent
Rudell et al.

(10) Patent No.: US 6,422,566 B1
(45) Date of Patent: Jul. 23, 2002

(54) TOY GUN GAME SET THAT ACTIVATES A GUN VIA A SIGNAL BEAM

(75) Inventors: Elliot A. Rudell, 30507 Rhone Dr., Rancho Palos Verdes, CA (US) 90275; George T. Foster, Long Beach; Ian B. Osborne, Gardena, both of CA (US)

(73) Assignee: Elliot A. Rudell, Torrance, CA (US)

( * ) Notice: Subject to any disclaimer, the term of this patent is extended or adjusted under 35 U.S.C. 154(b) by 0 days.

(21) Appl. No.: 09/590,479

(22) Filed: Jun. 8, 2000

Related U.S. Application Data

(60) Provisional application No. 60/178,900, filed on Jan. 28, 2000.

(51) Int. Cl.[7] ..... A63B 67/00

(52) U.S. Cl. ..... 273/445; 273/349

(58) Field of Search ..... 273/349, 457, 273/445; 463/5, 50; 434/22; 222/79; 446/405

(56) References Cited

U.S. PATENT DOCUMENTS

| | | | | | |
|---|---|---|---|---|---|
| 3,008,712 | A | * | 11/1961 | Konopka | 273/455 |
| 3,843,127 | A | * | 10/1974 | Lack | 273/349 |
| 4,040,622 | A | * | 8/1977 | Sinnott | 273/349 |
| 4,077,629 | A | * | 3/1978 | Chestney | 273/349 |
| 4,545,583 | A | * | 10/1985 | Pearman et al. | 463/5 |
| 4,772,028 | A | * | 9/1988 | Rockhold et al. | 463/5 |
| 5,785,592 | A | * | 7/1998 | Jacobsen | 273/349 X |
| 5,823,849 | A | * | 10/1998 | Gardner et al. | 273/349 X |
| 5,893,562 | A | * | 4/1999 | Spector | 273/349 |

* cited by examiner

*Primary Examiner*—Raleigh W. Chiu
(74) *Attorney, Agent, or Firm*—Irell & Manella, LLP

(57) ABSTRACT

A game set that allows a plurality of players to play a game of draw with water guns. The water guns are drawn from holsters that can be worn by the players of the game. The water gun that is drawn last is deactivated so that only the player who draws the water gun first can spray water.

22 Claims, 2 Drawing Sheets

TOY GUN GAME SET THAT ACTIVATES A GUN VIA A SIGNAL BEAM

REFERENCE TO CROSS-RELATED APPLICATIONS

This application claims priority to provisional application No. 60/178,900, filed Jan. 28, 2000.

BACKGROUND OF THE INVENTION

1. Field of the Invention

The present invention relates to electronically controlled water guns that are used in a game of draw.

2. Prior Art

There have been marketed numerous battery operated water guns. For example, Larami Corporation marketed a line of battery powered water guns under the name ENTERTECH. The ENTERTECH guns contained motor driven pumps that created a water pressure greater than pressure found in manually pressurized guns. Consequently, battery operated water guns were capable of projecting water farther than manually pressurized guns.

Toymax marketed a battery powered game set under the trademark CYBER SPLASH. The CYBER SPLASH game set included light sensitive targets integrated into vests that were worn by the players of the game. Each player would shoot a light beam onto the target worn by another player with a light gun. Water was released onto the player wearing a vest that was hit 10 times by the light beam of an opposing player.

U.S. Pat. No. 5,823,849 issued to Gardner et al. discloses a game set that contains a pair of battery powered water squirting shields. Each shield contains a water sensor that is coupled to a controller. When an opposing player is successful in hitting the sensor a predetermined number of times the controller closes a valve so that water cannot be emitted from the shield. This prevents that player from squirting another player. The player holding the shield is thereby penalized for allowing an opposing player to successfully hit the sensor.

There have also been marketed various types of water guns. By way of example, Larami Corp. sold a water gun under the trademark SUPERSOAKER. The SUPERSOAKER could emit a highly pressurized stream of water over a relatively long distance.

With the guns and game sets of the prior art each player can shoot the other player without any time constraints. It would be desirable to provide a gun game set that introduced time as a constraint to spraying an opponent.

BRIEF SUMMARY OF THE INVENTION

One embodiment of the present invention is a game set that includes a first gun that can be drawn from a first holster and a second gun that can be drawn from a second holster. The gun that is drawn last is deactivated so that the gun cannot spray a fluid.

DETAILED DESCRIPTION OF THE PREFERRED EMBODIMENT

A game set that allows a plurality of players to play a game of draw with water guns. The guns are drawn in response to a "GO" signal provided by a signal device. The water guns are drawn from holsters that can be worn by the players of the game. The water gun that is drawn last is deactivated so that only the player who draws the water gun first can spray water. Additionally, a water gun that is drawn before the GO signal is also deactivated. The present invention thus provides a water gun game set that incorporates a time constraint.

Figure 1:
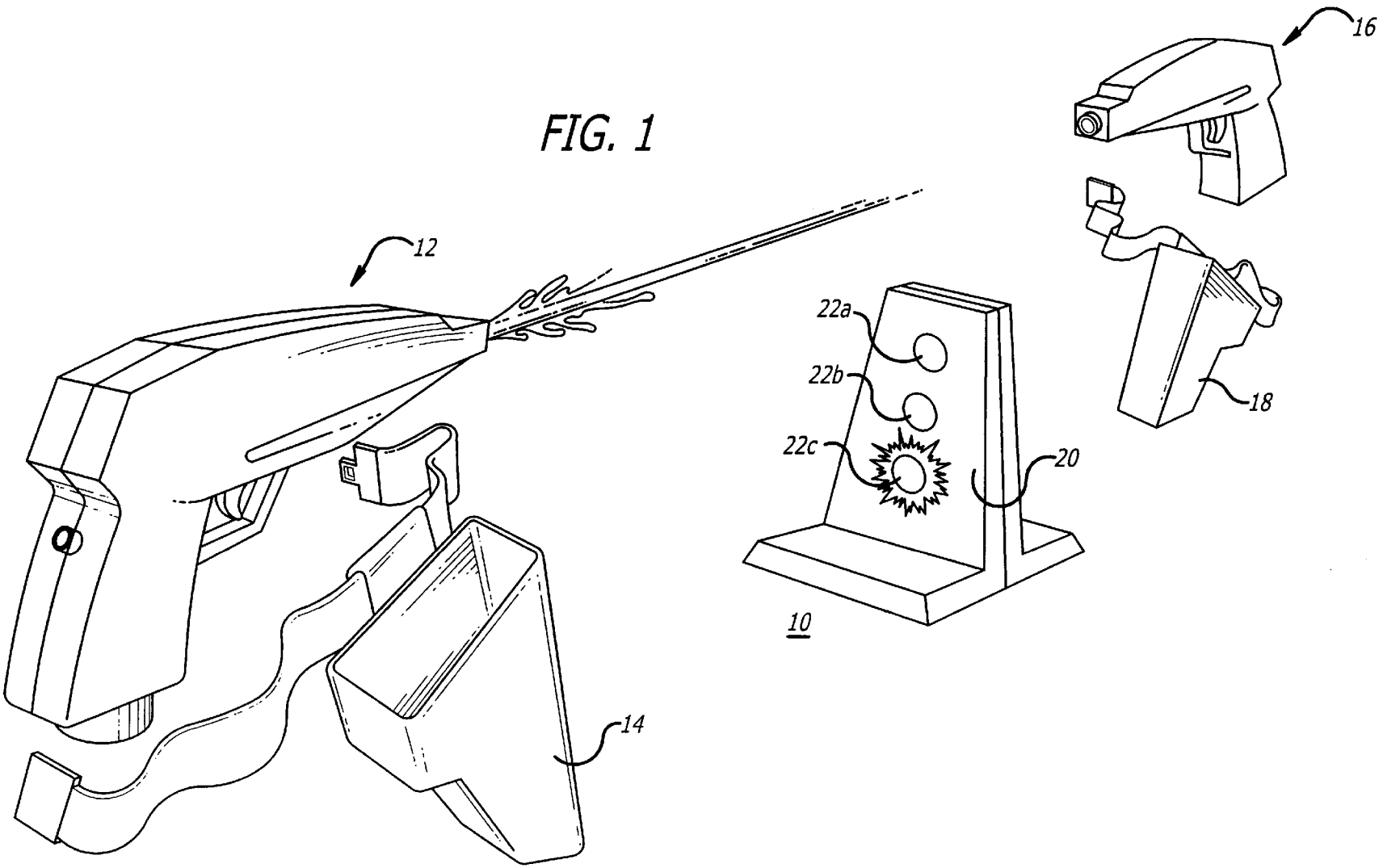
FIG. 1 is a perspective view of an embodiment of a game set of the present invention.

Referring to the drawings more particularly by reference numbers, FIG. 1 shows an embodiment of a game set 10 of the present invention. The game set 10 includes a first spray device 12 that can be drawn from a first holster 14 and a second spray device 16 which can be drawn from a second holster 18. The spray devices 12 and 16 are each adapted to spray a fluid such as water.

The spray devices 12 and 16 can be drawn from the holsters 14 and 18 in conjunction with a signal device 20. The signal device 20 may have a first light source 22*a*, a second light source 22*b* and a third light source 22*c* that are sequentially illuminated to provide an indication, or "GO" signal, of when to draw the spray devices 12 and 16 from the holsters 14 and 18, respectively. For example, the first light source 22*a* may become illuminated, followed by the second light source 22*b* and the third light source 22*c*. Illumination of the third light source 22*c* may provide an indication that the players can draw the spray devices 12 and 16 from the holsters 14 and 18, respectively. If a player draws a spray device 12 or 16 before the third light source 22*c* is illuminated the spray device is deactivated and the player cannot spray water. Additionally, the player who draws a spray device 12 or 16 last will have his spray device deactivated so that he cannot spray the other player.

Figure 2:
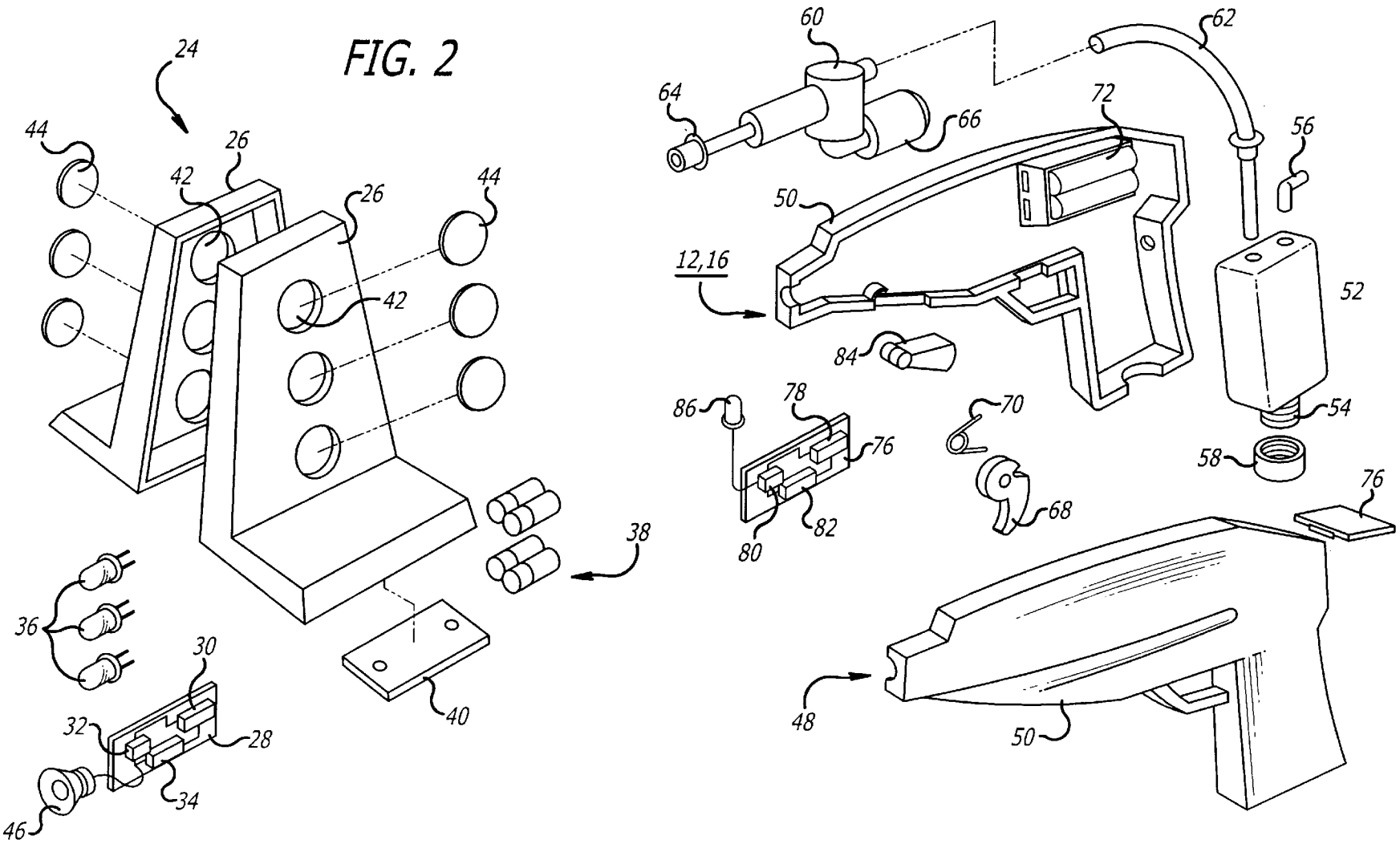
FIG. 2 is an exploded view of a signal device and a spray device of the game set.

FIG. 2 shows an embodiment of a spray device 12 or 16 and the signal device 20. The signal device 20 may include a housing 24 constructed from two separate molded plastic parts 26. The housing 24 may contain a printed circuit board assembly 28 that contains one or more electrical circuits. By way of example, the electrical circuits may include a controller 30, a memory 32 and a transceiver 34. The transceiver 34 may transmit and receive signals to and from the spray device 12 or 16. Although a transceiver 34 is described, it is to be understood that a transmitter can be substituted for the transceiver so that the signal device only transmits signals. The controller 30 may be a processor, discrete logic circuits or any combination of circuits to perform the logical computations required to operate the game set 10.

The signal device 20 may include light emitting diodes (LEDs) 36 that correspond to the light sources 22*a*, 22*b* and 22*c* shown in FIG. 1. The LEDs 36 may be coupled to the controller 30 and a plurality of batteries 38. The controller 30 may provide a switching function to control current from the batteries 38 to the LEDs 36 and selectively illuminate the light sources.

The batteries 38 may be enclosed within the housing 24 by a removable lid 40. The LEDs 36 may be located within openings 42 in the housing 24 and enclosed by lenses 44. Each lens 44 may have a different color. The signal device 20 may also include a speaker 46 that is coupled to the controller 30. The controller 30 may generate signals that create speech through the speakers. By way of example, the speech may compliment the illumination of the light sources such as "two, one, GO".

Each spray device 12 or 16 may include a housing 48 constructed from two separate molded plastic parts 50. The housing 48 may contain a tank 52 that can be filled with a fluid such as water through a tank opening 54. The tank 52 may further have a vent 56 and can be sealed by a cap 58.

The tank 52 can be connected to a pump 60 by a tube 62. The pump 60 is connected to a nozzle 64. The pump 60 is driven by a motor 66. The pump 60 contains a valve (not shown) that is controlled by a trigger 68. The trigger 68 is biased to an open position by a spring 70. Fluid will flow from the nozzle 64 when the motor 66 is activated and the trigger 68 is depressed. The motor 66 is powered by a plurality of batteries 72 enclosed by a battery lid 74. Although a pump 60 and motor 66 are shown and described, it is to be understood that other types of pressurization devices may be employed. For example, the gun may have an inflatable bladder or a manually activated pump.

Each spray device 12 or 16 may have a printed circuit board assembly 76 that includes a plurality of electrical circuits such as a controller 78, a memory 80 and a transceiver 82. The controller 78 could be a processor, discrete logical circuits or any combination of circuits to perform the logical computations required to operate the game set. The printed circuit board assembly 76 is connected to both the motor 66 and the batteries 72. The transceiver 82 can transmit and receive signals from the signal device 20. The controller 78 can provide a switch function to switch the motor 66 between active and inactive states. The controller 78 can also be coupled to a holster switch 84 to detect when the spray device is located within a holster, or drawn from a holster. The spray device 12 or 16 may further have a power on light source 86.

The controllers 30 and 78 may perform logical computations and control the light sources 22*a*, 22*b* and 22*c*, and active/inactive state of the device motors 66, based on interactive inputs and outputs from the signal device 20 and spray devices 12 and 16. By way of example, the controllers 30 and 72 can operate in the following manner.

When the spray devices 12 and 16 are located within the holsters 14 and 18, respectively, the controllers 78 of the devices 12 and 16 will cause the transceivers 82 to emit "in-holster" signals to the signal device 20. Upon receiving the in-holster signals the controller 30 may begin a countdown sequence. The light sources 22*a*, 22*b* and 22*c* are sequentially illuminated during the countdown sequence.

The controller 78 of each spray device 12 and 16 detects when a player removes the device 12 or 16 from the holster 14 or 18 through the holster switch 84. The controller 30 then generates a draw signal that is transmitted to the signal device 20. The signal device 20 transmits an encoded signal when the GO signal (illumination of light source 22*c*) is provided. The signal device 20 is capable of providing two different signals. Each signal contains an address or other code unique to one of the spray devices 12 and 16. Receipt of the encoded signal will cause the controller 78 to activate the motor 66 and allow a player to spray fluid from the device 12 or 16. If a spray device 12 or 16 does not receive an encoded signal the motor 66 of that device remains inactive. The controller 78 may switch the motor 66 to the active state after a predetermined interval so that the player can squirt water. Although activation and deactivation of the motor 66 is described, the ability to emit water from the gun may be controlled by a solenoid (now shown) that can lock and unlock the trigger 68. The solenoid may be controlled by the controller 78.

The controller 30 of the signal device 20 will determine whether a draw signal was received from a spray device before the end of the countdown sequence. The controller 30 will not provide an encoded signal to a spray device that emits a draw signal before the end of the countdown sequence. If both spray devices 12 and 16 are drawn after the countdown sequence has ended, then the controller 30 determines which spray device first transmitted a draw signal and then provide a coded signal only to that device. This allows only one player to squirt the other player with water thus creating a penalty by not drawing fast enough.

As an alternative method the signal device 20 may only have a transmitter that transmits a signal(s) to both spray devices 12 and 16 at the end of the countdown sequence. The controller 78 of the spray device that senses both the transmitted signal and the withdrawal of the device from the holster, may then transmit a deactivation signal to the other spray device to inactivate the motor of the other device.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, the game set may not have a signal device 20. With such an embodiment only the player who pulls their gun out of the holster first can spray water. By way of example, all guns may be activated when the guns are placed in the holsters. The gun that is drawn first may send a deactivation signal to deactivate the other gun(s). The deactivated gun may again become activated after a certain time interval. This allows the players to squirt water even when they are not playing a game of draw. The guns may also have a lock/unlock switch (not shown) that allows a player to squirt water even when not playing a game of draw.

What is claimed is:

1. A game set, comprising:

a signal device that provides a GO signal at a first time;

a first holster;

a first spray device that can be removed from said first holster at a second time, said first spray device being adapted to emit a fluid if the second time is subsequent to the first time;

a second holster; and, a second spray device that can be removed from said second holster at a third time, said second spray device being adapted to emit a fluid if the third time is subsequent to the first time and prior to the second time.

2. The game set of claim 1, wherein said first and second spray devices transmit an in-holster signal when said first and second spray devices are within said first and second holsters, respectively.

3. The game set of claim 2, wherein said signal device includes a counter that counts to a predetermined value when said signal device receives said in-holster signal.

4. The game set of claim 1, wherein said signal device transmits an encoded signal only to said first spray device.

5. The game set of claim 3, wherein said signal device includes a plurality of light sources that are sequentially illuminated in conjunction with the count of said counter to provide the GO signal.

6. The game set of claim 1, wherein said first spray device transmits a deactivation signal to said second spray device to deactivate said second spray device.

7. The game set of claim 1, wherein said first and second spray devices each contain a pump that is coupled to a motor, and an electrical circuit that can switch said motor between an activate state and an inactive state.

8. The game set of claim 7, wherein said first and second spray devices each include a holster switch coupled to said electrical circuit and which can engage said holsters.

9. The game set of claim 1, wherein said signal device includes a speaker.

10. A game set, comprising:

a signal device that contains a transmitter that transmits an encoded signal;

a spray device that has a receiver that can receive said encoded signal from said signal device, said spray device can be switched between an active state wherein a fluid can be emitted from said spray device and an inactive state wherein fluid cannot be emitted from said first spray device, the state of said spray device being dependent upon receiving the encoded signal from said signal device.

11. The game set of claim 10, wherein said spray device is in the active state when the encoded signal is received from said signal device.

12. The game set of claim 10, wherein said spray device includes a motor that is coupled to a pump and said receiver.

13. The game set of claim 10, wherein said signal device includes a counter and a plurality of light sources that are subsequentially illuminated in conjunction with a count of said counter to provide the encoded signal.

14. The game set of claim 10, further comprising a holster that can hold said spray device.

15. A game set, comprising:

a first holster;

a first spray device that can be removed from said first holster at a first time to emit a fluid;

a second holster; and a second spray device that can be removed from said second holster at a second time to emit a fluid, said second spray device being deactivated if the second time is subsequent to the first time.

16. The game set of claim 15, wherein said first spray device transmits a deactivation signal to said second spray device.

17. A method for playing a game of draw, comprising:

generating a GO signal;

drawing a first spray device from a first holster;

drawing a second spray device from a second holster;

deactivating said second spray device; and, emitting a fluid from said first spray device.

18. The method of claim 17, wherein the GO signal is an illuminated light source.

19. The method of claim 18, wherein a series of light sources are sequentially illuminated before the GO signal.

20. The method of claim 17, wherein the second spray device is deactivated if the second spray device is drawn from the second holster prior to the GO signal.

21. The method of claim 17, wherein the second spray device is activated after a predetermined time interval.

22. A method for playing a game of draw, comprising:

placing a first spray device in a first holster;

placing a second spray device in a second holster;

drawing the first spray device from the first holster; and, deactivating the second spray device.

* * * * *